US007632323B2

(12) United States Patent
Ganguly et al.

(10) Patent No.: US 7,632,323 B2
(45) Date of Patent: Dec. 15, 2009

(54) REDUCING ABRASIVE WEAR IN ABRASION RESISTANT COATINGS

(75) Inventors: Partha Ganguly, Belmont, MA (US); Alan O. Humphreys, Somerville, MA (US)

(73) Assignee: Schlumberger Technology Corporation, Ridgefield, CT (US)

( * ) Notice: Subject to any disclaimer, the term of this patent is extended or adjusted under 35 U.S.C. 154(b) by 234 days.

(21) Appl. No.: 11/322,106

(22) Filed: Dec. 29, 2005

(65) Prior Publication Data

US 2007/0154738 A1 Jul. 5, 2007

(51) Int. Cl.
*B32B 9/00* (2006.01)

(52) U.S. Cl. ..... 51/307; 51/309; 428/141; 428/156; 428/469; 428/698

(58) Field of Classification Search ..... 428/141, 428/156, 469, 472, 698; 51/307, 309
See application file for complete search history.

(56) References Cited

U.S. PATENT DOCUMENTS

| | | | | | |
|---|---|---|---|---|---|
| 4,499,795 | A * | 2/1985 | Radtke | ..... | 76/108.2 |
| 4,826,734 | A * | 5/1989 | Jackson et al. | ..... | 428/698 |
| 4,912,835 | A * | 4/1990 | Harada et al. | ..... | 492/3 |
| 5,075,129 | A * | 12/1991 | Jackson et al. | ..... | 427/451 |
| 5,145,739 | A * | 9/1992 | Sarin | ..... | 428/472 |
| 5,223,332 | A * | 6/1993 | Quets | ..... | 428/698 |
| 5,395,221 | A * | 3/1995 | Tucker et al. | ..... | 418/48 |
| 5,535,838 | A * | 7/1996 | Keshavan et al. | ..... | 175/374 |
| 5,645,896 | A | 7/1997 | Mills | | |
| 6,171,224 | B1 | 1/2001 | Phillips | | |
| 6,228,483 | B1 * | 5/2001 | Sarin | ..... | 428/472 |
| 6,615,935 | B2 * | 9/2003 | Fang et al. | ..... | 175/374 |
| 6,655,181 | B2 * | 12/2003 | Morales | ..... | 428/698 |
| 7,166,371 | B2 * | 1/2007 | Lakhotkin et al. | ..... | 428/698 |

FOREIGN PATENT DOCUMENTS

| | | |
|---|---|---|
| EP | 1260611 A2 | 11/2002 |
| GB | 2343134 A | 5/2000 |
| WO | 9935366 | 7/1999 |

OTHER PUBLICATIONS

Evans, A.G. and D.B. Marshall. "Wear Mechanisms in Ceramics." *Fundamentals of Friction and Wear of Materials*, Ed. D.A. Rigney. Metals Park, Ohio: American Society for Metals, 1981. pp. 438-452.
Hutchings, I.M. *Tribology: Friction and Wear of Engineering Materials*. London: Edward Arnold, 1992. pp. 155-156.

* cited by examiner

*Primary Examiner*—Archene Turner
(74) *Attorney, Agent, or Firm*—Brigid Laffey; James McAleenan; Jody DeStefanis

(57) ABSTRACT

An abrasion resistant coating and method are provided wherein the abrasion resistant coating contains both ductile and brittle components. The abrasion resistant coating is initially applied to a substrate and is further conditioned such that the wear which occurs at the interface of the abrasion resistant coating and the abrasive environment is ductile wear, as opposed to brittle wear, such that the wear which occurs at said interface is minimized and the service life of the abrasion resistant coating extended.

11 Claims, 4 Drawing Sheets

REDUCING ABRASIVE WEAR IN ABRASION RESISTANT COATINGS

FIELD OF THE INVENTION

The present invention relates to a method of improving the abrasive wear of abrasive resistant, or hardfacing coatings, and more particularly to conditioned hardfacing coatings having a distribution of reinforcement throughout its microstructure.

BACKGROUND OF THE INVENTION

The surfaces of downhole tools, when in contact with an abrasive environment such as a borehole wall, can undergo a high level of abrasion. In light of this, these surfaces are oftentimes coated with an abrasion resistant coating, in an effort to reduce wear and extend tool life. For example, abrasion resistant coatings, or hard facings, are often applied to susceptible areas of a tool such as wear bands, directional drilling pressure pads and stabilizers. Coatings such as these are typically a particulate metal matrix composite, based on a nickel or cobalt based alloy matrix containing tungsten carbide or titanium carbide particles. Using such a combination, both high degrees of hardness and toughness can be obtained.

These coatings are applied using a variety of methods such as weld overlays (MIG, plasma transfer arc, laser-cladding), thermal spray processes (high velocity oxygen fuel, D-gun, plasma spray, amorphous metal) and brazing (spray and fuse techniques) as known by those skilled in the art. In addition, wear resistant inserts, such as cemented tungsten carbide tiles or polycrystalline diamond (PDC, TCP) inserts are often attached to critical areas by brazing or other means to increase the wear resistance. Conventional abrasion resistant coatings such as these result in the application of a coating over a substrate that has a non-uniform surface that is oftentimes rough in texture.

While numerous hardfacing coatings have been produced for wear-resistant applications, none have been specifically designed to withstand the harsh environmental conditions encountered in downhole environments. The rubbing of a metal against a rock formation in the presence of drilling mud under high stress, together with repeated impact loading, creates a unique set of mechanisms that can lead to very rapid material loss.

In such an environment, the abrasive wear exhibited by traditional abrasion resistant coatings can be divided into two categories, namely brittle wear and ductile wear. Brittle wear occurs due to cracking and material removal at the surface of the abrasion resistant coating while ductile wear is exhibited by gradual material removal which results in a smoothing effect on the surface. The extent by which an abrasion resistant coating exhibits brittle or ductile wear is dependent on the local load the material must bear while in operation. For example, if the material at the surface of the abrasion resistant coating is brittle and the load applied is higher than its fracture stress (fracture under compressive load), the wear mechanism is brittle. In the alternative, if the load applied to the abrasion resistant coating is less than the fracture stress of the abrasion resistant coating, material is removed by a ductile wear mechanism. The wear rate under brittle wear is significantly higher than that in ductile wear. See I. M. Hutchings, *Tribology: Friction and Wear of Engineering Materials,* 1992 (incorporated herein by reference in its entirety).

Conventional approaches to minimizing wear in an abrasion resistant coating have resulted in the increase of the bulk hardness of the abrasion resistant coating by increasing the fraction of tungsten carbide reinforcement used in the abrasion resistant coating. Such an increase in the carbide volume fraction results in an increase of the wear resistance. However, at very high carbide volume fractions, extensive cracking can occur, as insufficient ductile matrix material is present to accommodate the residual stresses created during processing. For example, an abrasion resistant coating with a high carbide volume fraction applied using a plasma transfer arc method will likely result in a non-uniform surface that exhibits excessive cracking at various regions due to the lack of sufficient ductile matrix material.

Additionally, conventional methods for abrasion resistant coating leave a non-uniform surface finish exhibiting a rough texture with poorly attached clusters of solidified metal/carbide coatings. For example, during the aforementioned plasma transfer arc (PTA) technique, a powder is directed into a high temperature, ionized gas (i.e. plasma) that is created between a non-consumable electrode and a substrate. Temperatures in the plasma region range from 10,000-50,000 degrees F. (5,500-28,000 C.). Powder introduced into this region is melted and fusion welded to the underlying substrate. The fusion welded powder applied to the substrate has a rough surface finish and is non-uniform in nature, resulting in areas of weakly bonded globules of melted metal/carbide. When this surface is placed in contact with an abrasive environment, these weakly attached clusters of carbide readily detach from the surface of the abrasion resistant material, thereby causing accelerated wear and the formation of deep grooves which can nucleate and cause further surface damage to the abrasion resistant coating. In view of the above, a system, method and apparatus which results in the reduction of abrasive wear in abrasion resistant coatings is needed.

SUMMARY OF THE INVENTION

Aspects and embodiments of the present invention are directed to the reduction of the wear rate exhibited by a wear surface used within an abrasive environment. In accordance with one embodiment of the present invention a method for reducing the wear rate of a surface requires the providing of an initial wear surface exhibiting an initial surface roughness. This wear surface exhibits both brittle and ductile wear while used within an abrasive environment due to the existence of both brittle and ductile phases. In order to reduce the wear rate of the wear surface, it is necessary to reduce the contact stress between the wear surface and the abrasive environment to below the calculated brittle wear limit of the wear surface. Following such a reduction in contact stress, the wear surface will experience ductile wear, as opposed to brittle wear, wherein the rate of wear associated with ductile wear is less than the rate of wear associated with brittle wear. As the wear surface of the present invention may take numerous compositions, the brittle wear limit of the wear surface is variable and material dependent. For example, in one embodiment, the wear surface may be a tungsten carbide-cobalt (WC—Co) wear surface, wherein the cobalt component of the composite wear surface exhibits ductile wear behavior and the tungsten carbide component of the composite wear surface exhibits brittle wear characteristics. This wear surface may be applied at a uniform thickness along the substrate or may be of variable thickness along the substrate. A variable thickness wear surface provides for increased wear resistance along areas which experience the greatest amount of wear while in contact with an abrasive environment. For example, the leading edge of a drilling tool may be provided with a thicker wear surface as this area typically undergoes more rapid wear than a trailing edge of the same tool.

When employed within an abrasive environment such as a borehole, the reduction of the contact stress between the wear surface and the abrasive environment may be accomplished by appropriately conditioning the wear surface prior to interaction with the abrasive environment. In one embodiment, grinding or polishing a wear surface, originally applied using a plasma transfer arc, to a uniform surface finish that is smoother than the original finish results in a reduction of the contact stress between the wear surface and the abrasive environment to a value below the brittle wear limit of the wear surface. Following such polishing and grinding, a wear pad of a directional drilling apparatus operating within an abrasive environment such as a borehole will experience reduced wear and improved tool life.

In an alternate embodiment, an abrasion resistant coating for use within an abrasive environment is provided. This abrasion resistant coating includes a tool element and a substrate associated with the tool element. Additionally, a wear surface coating is provided wherein the wear surface coating is in contact with the substrate and the abrasive environment. This wear surface coating has a conditioned surface finish exhibiting a surface roughness below a critical roughness which is chosen to reduce abrasive wear between the tool element and the abrasive environment. In one example, the tool element may be a directional drilling apparatus for use within an abrasive environment such as a borehole. Furthermore, the provided wear surface coating may be a tungsten carbide-Cobalt (WC—Co) coating having between 40-60% tungsten carbide by volume. When using a wear surface coating such as this, the conditioned surface may have a 320 grit finish for use in reducing the abrasive wear exhibited.

In an alternate embodiment, a method for producing an abrasive resistant coating on a substrate is recited, including providing of a ductile metal matrix and providing a reinforcement within said ductile metal matrix from about 40% to 70% volume of the abrasion resistant coating for use as a reinforcement. The ductile metal matrix and reinforcement is deposited onto the substrate and further conditioned to provide a uniform surface finish below a critical roughness. Numerous suitable ductile metal matrices exist, such as, but not limited to, a nickel metal matrix or a boron metal matrix. Reinforcement also may take numerous forms, including but not limited to tungsten carbide or titanium carbide.

The critical roughness associated with a variety of abrasion resistant coatings is highly variable. When using a surface coating with 40% tungsten carbide, for example, the critical roughness is about 1 micrometer. A surface coating with 50% tungsten carbide requires a critical surface roughness of about 0.3 micrometers. A coating with 60% tungsten carbide requires a surface roughness of about 0.1 micrometers. Each of these surface coating may be applied using a variety of means, including but not limited to the use of a thermal spray process. The substrates to which these surface coatings are applied are numerous but may include the wear pads of a directional drilling apparatus.

BRIEF DESCRIPTION OF THE DRAWINGS

The accompanying drawings, are not intended to be drawn to scale. In the drawings, each identical or nearly identical component that is illustrated in various figures is represented by a like numeral. For purposes of clarity, not every component may be labeled in every drawing. In the drawings.

DETAILED DESCRIPTION OF THE INVENTION

Figure 1:
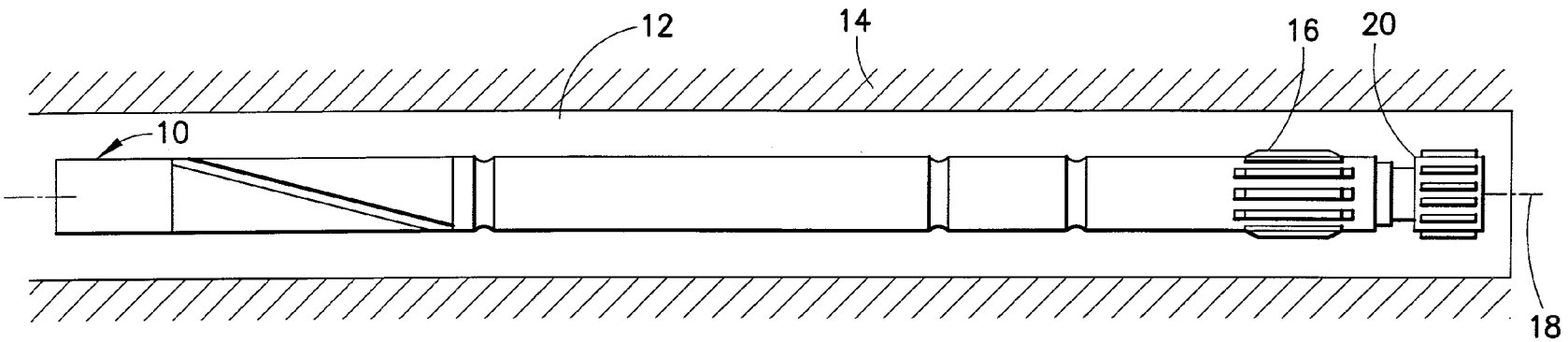
FIG. 1, an exemplary tool element using a coating system, method and apparatus suitable for use with the present invention.

Various embodiments and aspects of the invention will now be described in detail with reference to the accompanying figures. This invention is not limited in its application to the details of construction and the arrangement of components set forth in the following description or illustrated in the drawings. The invention is capable of various alternative embodiments and may be practiced using a variety of other ways. Furthermore, the terminology and phraseology used herein is solely used for descriptive purposes and should not be construed as limiting in scope. Language such as "including," "comprising," "having," "containing," or "involving," and variations herein, are intended to encompass both the items listed thereafter, equivalents, and additional items not recited. Furthermore, the terms "hardface surface", "wear surface", "multiphase wear surface", "abrasive resistant coating", "abrasion resistant surface" and variations herein will be used interchangeable to describe the present invention. Additionally, the term "abrasive environment" includes any environment or setting which results in abrasive wear or a wear surface in communication with the abrasive environment due to interaction of the wear surface with the abrasive environment.

As illustrated in FIG. 1, an exemplary downhole tool is shown, wherein the tool embodies various aspects of the present invention. This downhole tool is, more particularly, a section of a directional drilling string assembly 10. This direction drilling string assembly 10 is used in the directional drilling of a wellbore 12 through an abrasive environment 14 such as a rock formation. In the present embodiment, the directional drilling string 10 includes one or more wear pads 16 located in proximity to the cutting head 20. Furthermore, the cutting head 20 is free to deviate from the centerline of the wellbore axis 18 such that the direction of the wellbore 12 may be controlled. To effectuate a direction change from the centerline of the wellbore axis 18, a wear pad 16 is extended to push against the wellbore 12. This extension of a wear pad 16 may be accomplished using a variety of means, including but not limited to the use of hydraulic pressure or compressed air. For example, drilling fluid (mud) may be used as an appropriate hydraulic power source for actuating and extending a wear pad 16. Following extension of the wear pad 16, the cutting head 20 may be displaced relative to the centerline of the wellbore 18 such that a direction change is accomplished.

In the present embodiment the directional drilling string 10, and in particular the wear pad 16, is an example of an apparatus particularly suitable for use with a hardface or abrasive resistant coating. As the wear pad 16 is in direct contact with the abrasive environment 14, the use of a abrasive resistant coating aids in extending the life of the wear pad 16 while the tool is in use. While conventional abrasive resistant coatings provide increased life of the wear pad 16, the abrasive resistant coating of the present invention is particularly suitable for extending the life of the wear pad 16 beyond that of conventional coatings known by one skilled in the art. Additionally, elements such as the wear pad 16 of the present embodiment are often consumable items requiring periodic replacement as the abrasive resistant coating is compromised during use. Reducing the wear of the abrasive resistant coating, thereby extending the service life of an element like a wear pad 16, results in increased productivity and decrease costs, as the directional drilling drill string 10 need not be removed from the wellbore as frequently.

While the above description details the application of the present abrasive resistant coating to a directional drilling drill string 10, and more particularly to a wear pad 16 of the directional drilling drill string 10, one skilled in the art will readily recognize that the present invention may be utilized with a variety of alternative downhole tools or other elements not presently described herein including applications outside of the oilfield industry. For example, bearing surfaces or stabilizer regions associated with the drill string 10, wherein these bearing surfaces are in contact with the abrasive environment 12 of a borehole, may be additionally coated with the abrasive resistant coating of the present invention. Furthermore, the present invention can be applied to reduce abrasive wear in a variety of abrasive resistant coatings beyond the present embodiment illustrated in FIG. 1, including but not limited to the appropriate chemical, mechanical or metallurgical arts. The application of the present invention to these alternative uses, although not explicitly addresses in detail, is contemplated to be within the scope of the present invention. In view of this, the illustrated embodiment is not intended to be limiting in scope.

Figure 2A:
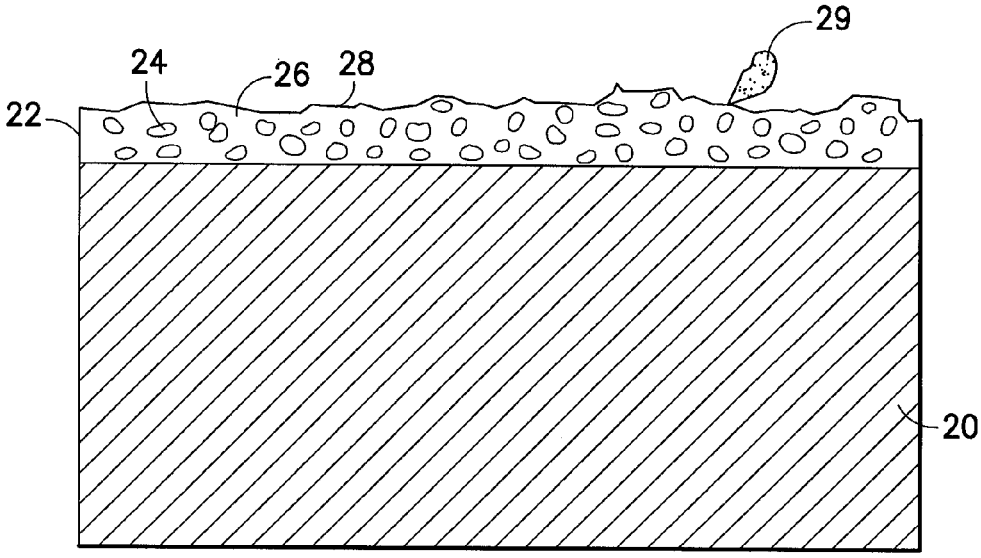
FIG.2A PRIOR ART
FIG. 2A is an illustration of a prior art wear resistant coating as applied to a substrate.
Figure 3A:
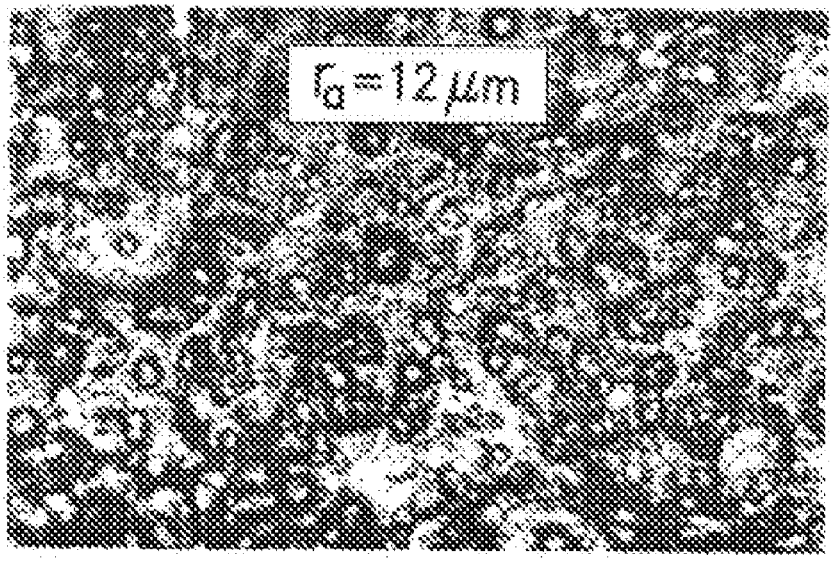
FIG. 3A is a microscopic view of the prior art surface structure of a wear resistant coating.

FIG. 2A is an illustrative embodiment of a prior art abrasion resistant coating 22, as applied over a substrate 20. In one embodiment, this abrasive resistant coating 22 may be, but is not limited to, a composite coating based on a nickel or cobalt based alloy matrix 26 containing tungsten or titanium carbides particles 24 dispersed throughout. These tungsten or titanium carbide particles impart hardness to the coating, which in turn provides the desired wear resistance. The substrate 22 may be a variety of metallic substances as understood by one skilled in the art. As set forth prior, this composite abrasive resistant coating 22 may be applied using a variety of techniques. Regardless of technique used, the surface finish 28 of the abrasion resistant coating 22 is rough in texture following application. An example of the surface finish 28 of an "as applied" abrasive resistant coating is illustrated in FIG. 3A. In FIG. 3A, the mean surface roughness ($r_a$) of the illustrative example is 12 μm. Mean surface roughness ($r_a$) is herein defined as the arithmetic mean of the absolute values of the deviation of the surface profile from the baseline (or mean value) surface. Thus, $R_a$ of 1 μm for a surface indicates that the average height of the peaks (or the depths of the valleys) for the surface profile is 1 μm. The illustrated mean surface roughness of 12 μm is in keeping with that which is experienced following the application of traditional abrasive resistant coatings to a substrate.

The "as applied" surface finish 28, as illustrated in FIGS. 2A and 3A, includes a region of loosely attached reinforcement carbides 29. This region of loosely attached reinforcement carbides 29 is likely to detach from the hardface coating 22 upon contact with the abrasive environment. For example, when used within a wellbore, these carbides are oftentimes trapped between the hardface coating region and the wellbore, resulting in excessive scouring and accelerated wear of the hardface coating. Furthermore, deep gouges caused by scouring of the loosed carbides against the hardface coating can nucleate further damage throughout the abrasive resistant coating, resulting in rapid deterioration of the hardface coating and shortened tool life. One objective of the present invention is to reduce the rapid deterioration caused by loose carbides, thereby extending the time before the abrasive resistant coating of a tool element needs to be replaced.

Figure 2B:
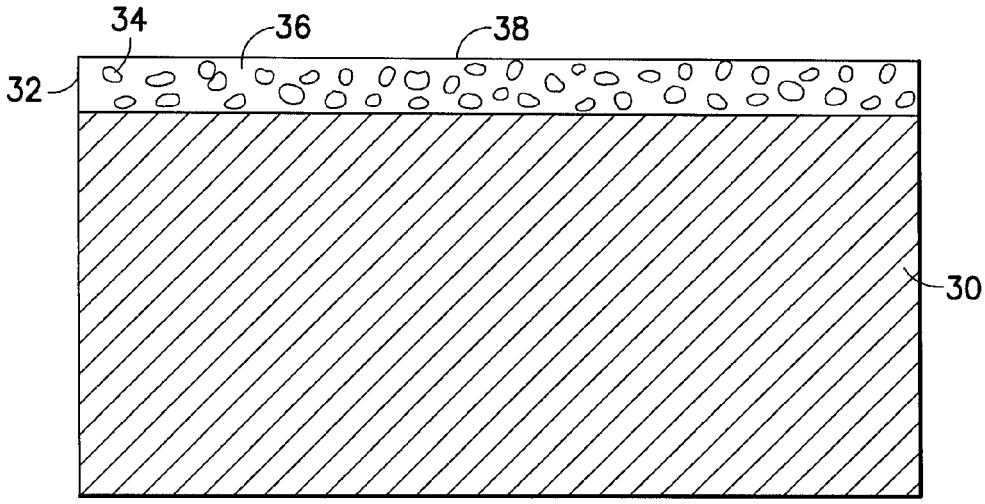
FIG. 2B is an illustration of an applied wear resistant coating as applied to a substrate in accordance with the present invention.

FIG. 2B is an illustrative embodiment of the present invention for use within an abrasive environment such as a borehole. The substrate 30 of the present embodiment is a portion of a tool element used within the abrasive environment. For example, the tool element may be a directional drilling drill as illustrated in FIG. 1, wherein the tool element and substrate is metallic in nature. More particularly, the tool element may be a wear pad used within the directional drilling drill string illustrated above. One skilled in the art will readily recognize that the tool element and associated substrate may be manufactured from a variety of materials. The illustration of a metallic tool element in the present invention is therefore not intended to be limiting in scope and is used solely for illustrative purposes. A skilled artisan will note that the substrate may be, but is not limited to, non-metallic elements such as plastics, resins or phenolics, as well as a variety of metallic elements as necessitated by the conditions of the particular application.

Further associated with the tool element (not shown) and substrate 30 is a wear surface 32. In one embodiment this wear surface 32 is in communication or contact with the substrate 30 and is further in contact with the abrasive environment (not shown). The wear surface may be associated with the substrate using a variety of techniques, a non-conclusive list which as been recited herein. Additional techniques not recited herein for associating a wear surface 32 with a substrate 30 are well understood by one skilled in the art, and the lack of inclusion of these techniques is not intended to be limiting on the scope of the present invention.

The wear surface 32 of the present embodiment is a multiphase abrasive resistant coating as illustrated by the two phases present 34,36 in the illustrated embodiment. For the purpose of clarity, the wear surface 32 of the present invention will be described relative to a tungsten carbide-cobalt (WC—Co) wear surface. This assumption is solely for clarity and is not intended to limit that which claimed in the present invention. Alternative wear surfaces 32, such as a titanium carbide-nickel wear surfaces, exist and are well understood by a skilled artisan.

Figure 3B:
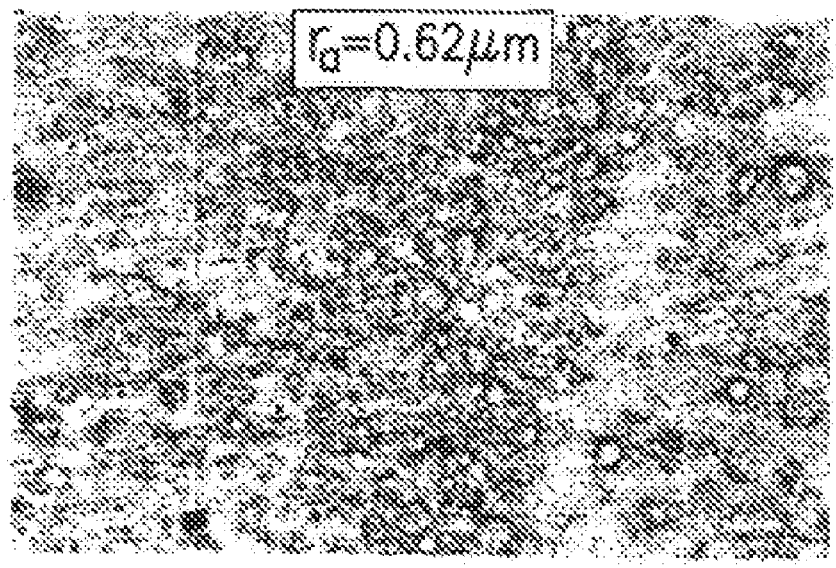
FIG. 3B is a microscopic view of the surface structure of a wear resistant coating in accordance with the present invention.

The illustrative WC—Co wear surface 32 includes a cobalt metal matrix 36 which has a plurality of tungsten carbide particles 34 dispersed throughout. As illustrated in the present embodiment, the surface finish 38 of the wear surface 32 has a uniform finish at a reduced roughness as compared to the "as applied" surface finish illustrated in FIGS. 2A and 3A. A view of the reduced roughness surface finish 38 of the present embodiment is illustrated in FIG. 3B, wherein a mean surface roughness ($r_a$) of 0.62 μm is illustrated. This uniform surface finish 38, or polished surface finish, exhibits a surface roughness below the critical surface roughness, wherein this surface roughness is chosen to reduce the abrasive wear between the tool element and the abrasive environment. The surface finish 38 of the present embodiment may be achieved using a variety of conditioning means, including but not limited to grinding, polishing, or precise control of the wear surface application process. For example, the surface roughness illustrated in FIGS. 2B and 3B may be achieved using progressive polishing or grinding passes with abrasives having finer and finer particle sizes, such that each polishing or grinding pass results in a progressively smoother surface approaching the requisite surface roughness illustrated. In one embodiment of the present invention, for example, the wear surface should be prepared such that the final grinding and polishing is accomplished with abrasives having a 320 grit finish and higher. Suitable grinding and polishing mediums are Silicon Carbide or Aluminum Oxide (SiC or $Al_2O_3$) abrasives.

While mechanical grinding and polishing is discussed as means for achieving the required surface finish of the uniform wear surface 38, the requisite surface roughness 38 of the present embodiment may be obtained using numerous alternative or additional means and methods as understood by one skilled in the art. For example, the need to grind the wear surface 32 to achieve a uniform surface finish 38 at a roughness below the critical roughness may be eliminated altogether by adequately and precisely controlling the initial "as applied" wear surface 32 such that the roughness of the uniform surface 38 exhibits is achieved during the application process. Such application controls of the wear surface during application thereby eliminates the required steps of conditioning the "as applied" finish to obtain a finish at the required roughness below the critical roughness.

Figure 4:
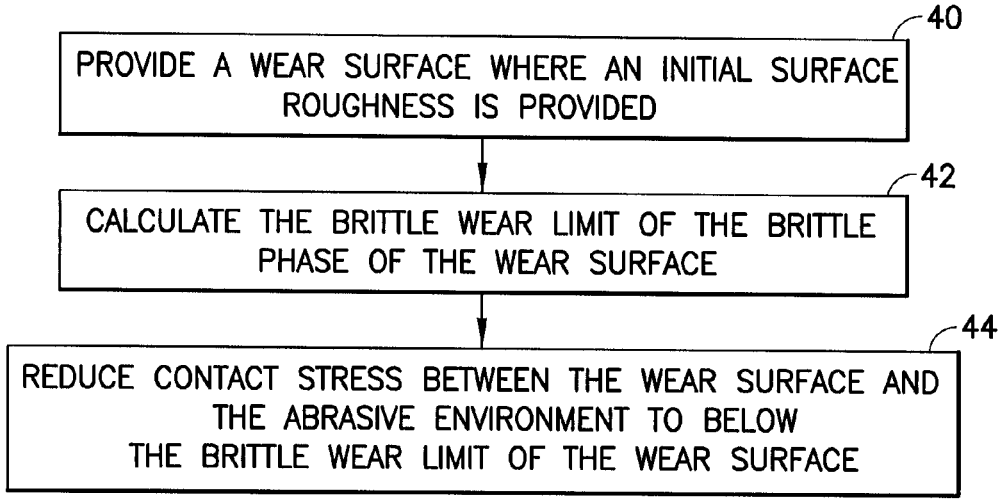
FIG. 4 is a flowchart illustrating the steps necessary in performing an embodiment of the present invention.

FIG. 4 is a flowchart illustrating one embodiment of the present invention. At 40, a wear surface with an initial surface roughness is provided. This initial wear surface is a multiphase wear surface, having both a brittle phase and a ductile phase. The brittle phase traditionally undergoes brittle wear due to cracking and sudden material removal at the surface. In contrast, the ductile phase undergoes ductile wear where the material removal is more gradually removed. Ductile wear of a wear surface has a smoothing effect on the wear surface. In a tungsten carbide-cobalt (WC—Co) wear surface, for example, the cobalt phase traditionally exhibits ductile wear characteristics, while the tungsten carbide phase oftentimes undergoes rapid brittle wear when in use.

The applicable wear mechanism, namely brittle or ductile wear, depends on the local load the wear surface material has to bear. For example, if the material of the wear surface in a drilling tool is brittle and the load is higher than its fracture stress (i.e. fracture under a compressive load), the wear mechanism is brittle. If the load experienced at the wear surface is less than the fracture stress of the wear surface, material removal occurs due to ductile wear. It is one intention of the present invention to maintain a ductile wear mechanism at the interface between a wear surface and an abrasive environment such that the rate of wear surface loss is minimized.

In an effort to reduce the wear rate of a wear surface used in an abrasive environment the brittle wear limit, or fracture stress, of the wear surface is calculated at 42 such that the contact stress between the wear surface and the abrasive environment can be reduced to below this brittle wear limit at 44. The load or stress to reach the transition point between ductile wear and brittle wear, i.e. the brittle wear limit, may be calculated in accordance with the findings of Evans and Marshall (A. G. Evans and D. B. Marshall, Wear Mechanisms in Ceramics, in: Fundamentals of Friction and Wear of Materials, ed. D. A. Rigney, American Society of Metals, OH, 439 (1981)) which is herein incorporated by reference in its entirety. Experimental data relating to tungsten carbide (WC) particles shows that the applicable load is approximately 6 Newtons (N). For a WC particle with a circular cross-section exposed to the abrasive environment, and a mean diameter of 65 microns (as experimentally determined), the applicable fracture stress is 2 GPa. Therefore, the calculated brittle wear limits is approximately 2 GPa at 42 of the illustrative embodiment. Reducing the contact stress at the interface of the wear surface and the abrasive environment 44 to below this brittle wear limit will therefore ensure that the applicable wear mechanism at the wear surface is ductile wear.

Reduction of the contact stress between the wear surface and the abrasive environment may take numerous forms as understood by one skilled in the art. In one embodiment, contact stress may be reduced by conditioning the multiphase wear surface. Conditioning may include the reduction of the surface roughness ($R_a$) as the contact stress at a wear surface interacting with an abrasive environment increases with an increase in surface roughness ($R_a$). Experimental results using a multiphase wear surface having 40% WC, 50% WC and 60% WC (by volume) yield a critical roughness $R_a$~1 μm, 0.3 μm and 0.1 μm, respectively. These experimental results were determined using a borehole surface with a roughness of $R_a$~2 μm, and nominal contact pressure between the wear surface and the abrasive environment was 5 MPa. Roughness ($R_a$) and contact pressure values such as these are commonly encountered by a directional drilling apparatus operating within a borehole. These experimental results are solely for illustrative purposes and are not intended to be limiting of the scope of the present application.

Figure 5:
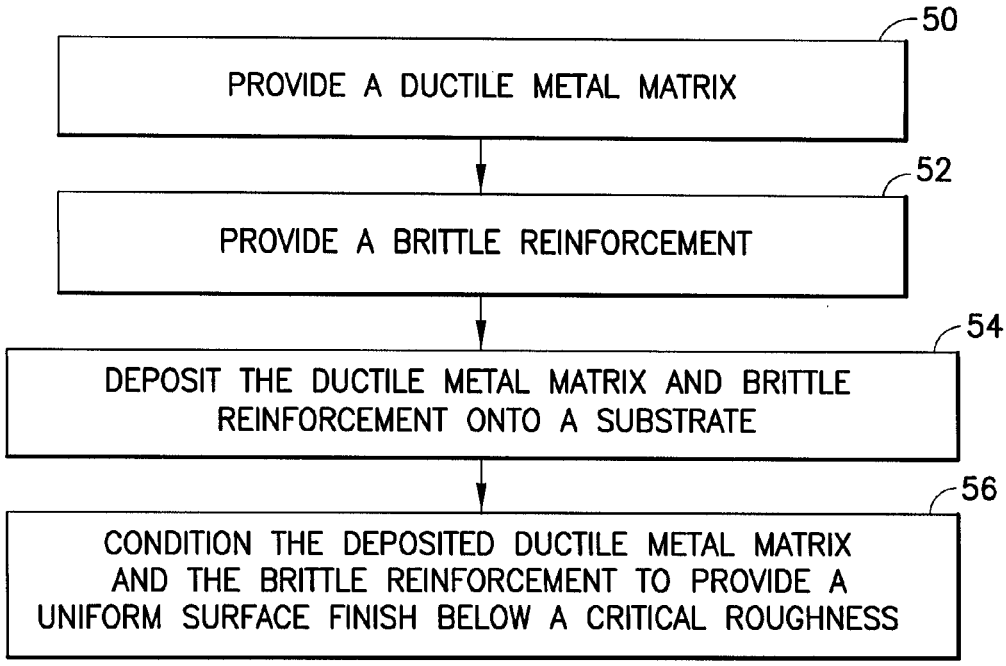
FIG. 5 is a flowchart illustrating the steps necessary in performing an embodiment of the present invention

FIG. 5 is a flowchart illustrating the steps necessary in practicing an alternative embodiment of the present invention. In accordance with step 50, a ductile metal matrix is first provided. As set forth prior this ductile metal matrix may take numerous forms, including, but not limited to, a nickel or cobalt based metal matrix. A brittle reinforcement is further provided at 52 wherein the reinforcement is provided from about 40% to 70% volume of the abrasive resistant coating. As understood by one skilled in the art, this brittle reinforcement may take numerous forms such as tungsten carbide or titanium carbide. Alternatively, numerous additional reinforcements which are acceptable may be used in accordance with the present invention. The ductile metal matrix and the brittle reinforcement is then deposited on a substrate at 54. The deposit of this ductile metal matrix and reinforcement may be uniform in thickness or may be variable in thickness, as required by the application and intended use. As recited herein, this may occur using a variety of mechanisms and techniques understood by one skilled in the art. The deposited ductile metal matrix and brittle reinforcement is then conditioned at 56 to provide a uniform surface finish which exhibits a surface roughness below the critical surface roughness.

The apparatus, systems, and methods described above are particularly adapted for oil field and/or drilling applications, e.g., for protection of downhole tools. It will be apparent to one skilled in the art, however, upon reading the description and viewing the accompanying drawings, that various aspects of the inventive apparatus, systems and methods are equally applicable in other applications wherein protection of machine or tool elements is desired. Generally, the invention is applicable in any environment or design in which protection of machine or tool elements subjected to the various wear conditions described above is desired.

The foregoing description is presented for purposes of illustration and description, and is not intended to limit the invention in the form disclosed herein. Consequently, variations and modifications to the inventive hardface coating systems and methods described commensurate with the above teachings, and the teachings of the relevant art, are deemed within the scope of this invention. These variations will readily suggest themselves to those skilled in the relevant oilfield, machining, and other relevant industrial art, and are encompassed within the spirit of the invention and the scope of the following claims. Moreover, the embodiments described (e.g., tungsten carbide-cobalt hardface coatings with a uniform surface finish at a roughness below the critical roughness) are further intended to explain the best mode for practicing the invention, and to enable others skilled in the art to utilize the invention in such, or other, embodiments, and with various modifications required by the particular applications or uses of the invention. It is intended that the appended claims be construed to include all alternative embodiments to the extent that it is permitted in view of the applicable prior art.

What is claimed is:

1. A downhole tool element having an abrasion resistant coating for use within an abrasive environment, said abrasion resistant coating comprising:

a substrate consisting of a portion of the downhole tool element;

a multiphase wear surface coating containing about 40%-60% Tungsten Carbide (WC) by volume in contact with the portion of the downhole tool element and provides as an interface between the portion of the downhole tool element and the abrasive environment, said multiphase wear surface coating having a brittle fracture stress limit; and wherein said multiphase wear surface coating has a conditioned surface finish with a surface roughness (Ra) below a critical surface roughness (Ra) of approximately 1 micrometer (μm), said surface roughness (Ra) selected to reduce the contact stress at the interface of the multiphase wear surface coating and the abrasive environment to below the brittle fracture stress limit of the multiphase wear surface coating.

2. The abrasion resistant coating of claim 1, wherein the conditioned surface finish is provided by grinding and polishing the wear surface to a roughness below the critical surface roughness (Ra).

3. The abrasion resistant coating of claim 1, wherein the conditioned surface finish is provided by controlling the application of the wear surface onto the substrate to provide a wear surface with a roughness below the critical surface roughness (Ra).

4. The abrasion resistant coating of claim 1, wherein the critical surface roughness (Ra) is about 1 micrometer (μm) for a multiphase surface coating of 40% Tungsten Carbide (WC) by volume.

5. The abrasion resistant coating of claim 1, wherein the critical surface roughness (Ra) is about 0.3 micrometer (μm) for a multiphase surface coating of 50% Tungsten Carbide (WC) by volume.

6. The abrasion resistant coating of claim 1, wherein the critical surface roughness (Ra) is about 0.1 micrometer (μm) for a multiphase surface coating of 60% Tungsten Carbide (WC) by volume.

7. The abrasion resistant coating of claim 1, wherein said downhole tool element being a directional drilling apparatus.

8. The abrasion resistant coating of claim 1, wherein said wear surface has a hardness value greater than the substrate surface to which the wear surface is applied.

9. The abrasion resistant coating of claim 1, wherein said wear surface is applied to the substrate at a variable thickness.

10. The abrasion resistant coating of claim 1, wherein said wear surface is conditioned by controlling the initial surface roughness (Ra) during application of the wear surface to the substrate such that the critical surface roughness (Ra) is below approximately 1 micrometer (μm).

11. The abrasion resistant coating of claim 1, wherein said wear surface finish has a 320 grit texture.

* * * * *